US007549217B2

(12) United States Patent
Day et al.

(10) Patent No.: US 7,549,217 B2
(45) Date of Patent: Jun. 23, 2009

(54) METHOD FOR FABRICATING AN ELECTROMAGNET

(75) Inventors: Arthur C. Day, Seattle, WA (US); Bruce David Stanley, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/581,284

(22) Filed: Oct. 16, 2006

(65) Prior Publication Data

US 2007/0028440 A1 Feb. 8, 2007

Related U.S. Application Data

(62) Division of application No. 10/424,462, filed on Apr. 28, 2003, now Pat. No. 7,148,776.

(51) Int. Cl.
*H01F 7/06* (2006.01)

(52) U.S. Cl. ..... 29/605; 29/602.1; 29/606; 335/285; 335/286; 335/295

(58) Field of Classification Search ..... 29/602.1, 29/605, 606; 335/285–295
See application file for complete search history.

(56) References Cited

U.S. PATENT DOCUMENTS

| | | | | |
|---|---|---|---|---|
| 2,421,716 | A | 6/1947 | Rose | |
| 2,607,307 | A | 8/1952 | Funk | |
| 3,056,071 | A | 9/1962 | Baker et al. | |
| 3,363,209 | A | 1/1968 | Pevar | |
| 4,121,865 | A | 10/1978 | Littwin, Sr. | |
| 4,471,331 | A | 9/1984 | Wyatt | |
| 4,538,131 | A | 8/1985 | Baier et al. | |
| 4,575,143 | A | 3/1986 | Nast | |
| 4,582,460 | A | 4/1986 | Silverberg et al. | |
| 4,684,112 | A | 8/1987 | Chernikov et al. | |
| 4,834,870 | A | 5/1989 | Osterberg et al. | |
| 5,041,806 | A | 8/1991 | Enderle et al. | |
| 5,630,269 | A | 5/1997 | Wasserbaech et al. | |
| 5,826,928 | A | 10/1998 | Shang | |
| 6,005,460 | A | 12/1999 | Garrigus et al. | |
| 6,357,101 | B1 | 3/2002 | Sarh et al. | |
| 6,371,274 | B1 | 4/2002 | Ditter et al. | |
| 6,392,517 | B1 | 5/2002 | Coleman, Jr. et al. | |
| 6,812,620 | B2 * | 11/2004 | Scheeper et al. | 310/324 |
| 7,036,207 | B2 * | 5/2006 | Neal | 29/597 |

OTHER PUBLICATIONS

*Magnetool® Electromagnets—Rectifiers, Controllers, Lifting Magnets, Automation Applications, Stand-By Safety Systems*; 5 pages; Magnetool Inc., Troy, Michigan (undated).
*Selecting Electromagnets and Rectifier/Controllers*; 8 pages; Magnetool Inc., Troy, Michigan (undated).

* cited by examiner

*Primary Examiner*—Paul D Kim
(74) *Attorney, Agent, or Firm*—Alston & Bird LLP

(57) ABSTRACT

A method of of fabricating an electromagnet is provided in which a core having a flux return backplate on one end and a cover plate on the other end of the core is provided. For example, the flux return backplate may be fixed to one end of the core and the cover plate may be fixed to the other end of the core. A plurality of layers of wire may then be wound about the core between the flux return backplate and the cover plate, prior to fixing a flux return ring to the cover plate to at least partially enclose the wire.

14 Claims, 4 Drawing Sheets

METHOD FOR FABRICATING AN ELECTROMAGNET

CROSS-REFERENCE TO RELATED APPLICATION

The present application claims priority to and is a divisional of U.S. patent application Ser. No. 10/424,462 filed Apr. 28, 2003 now U.S. Pat. No. 7,148,776, the contents of which are incorporated herein in their entirety.

BACKGROUND OF THE INVENTION

The present invention relates to utilizing an electromagnetic assembly to securely clamp a structure, such as a multiple layer structure, and in particular to securely clamp the structure at a location where an operation is to be performed on the structure, while not obstructing the location where the operation is to be performed.

In many industries, operations must be performed on structures, such as multiple layer structures, and problems arise if the multiple layers of the structure cannot be securely held together during the operation. For example multiple layer structures, particularly those structures that are subject to significant dynamic forces and/or pressure over their lifetime, such as aircraft bodies, bridges, vehicle bodies, buildings, and others, must be properly secured with fasteners and/or adhesive in order to ensure that the structure will perform as intended over its lifetime.

Typically, to properly secure a fastener in a multiple layer structure, a hole must be drilled through the multiple layer structure at the desired location of the fastener. The hole must not have any sharp edges, i.e., burrs, there must not be debris between the layers, and any sealant applied between the layers in order to make the structure air and/or water tight must be sufficiently squeezed out. When excess sealant is present between the layers, the distance between the layers is increased and/or uneven, which may be referred to as a "gasket" condition. Thus, if burrs, debris and/or excessive sealant are present, then the layers cannot be properly fastened, and the layers may suffer corrosion, cracking and/or premature fatigue failure, which generally renders the structure ineffective for its intended purpose and, therefore, subject to the expense of repair or replacement.

Ensuring that a proper hole is drilled is, therefore, an integral part of fastening multiple layer structures together. In the aerospace industry, for example, a significant amount of time and labor is expended ensuring that the holes through the various layers of the aircraft structure are appropriately drilled, cleaned, sealed and fastened. Initially, the layers of materials that form the structure are loosely assembled without sealant, and drill templates are aligned and attached to the structure in the areas to be drilled. A drill operator, guided by the drill template, then drills holes through the layers of materials typically using a manual drill motor. As the hole is being drilled through the layers, the drill bit tip pushes with the full feed force applied to the drill motor. This can cause a gap to develop between a drilled layer and the next layer, particularly when the layers are a stack-up of thin material. The gap between the layers causes burrs about the hole and debris is likely to gather between the layers. Thus, once the holes are drilled, the layers must be disassembled, the burrs must be removed from the holes, and the debris must be cleaned from the surfaces of the layers, all of which is a time-consuming and labor intensive process.

Sealant is then applied to the layers prior to re-assembling the layers. In order to ensure the layers are properly sealed to provide an air and water-tight seal, a generous amount of sealant is applied to the layers. Clamps that extend through the holes, such as KWIK-LOK™ clamps commercially available from Zephyr Manufacturing Company, Inglewood, Calif., must be placed through each hole of the reassembled layers in order to squeeze out the sealant to prevent excessive "gasket" between the layers before the sealant dries. The extra sealant squeezes out around the clamps and must be cleaned from the structure and the clamps during clamping and/or after the clamps are removed. If the holes are satisfactory, then fasteners may be installed and fastened with nuts or swage lock collars. Overall, this process is expensive, laborious, and time-consuming. In addition, the integrity of the resulting holes depends upon the completion of many manual processes, which creates a risk that certain steps may be performed inadequately or completely overlooked.

In addition, when adhesive is utilized to bond multiple layers of a structure, then the layers typically must be clamped together as the adhesive cures or dries to ensure that the adhesive is sufficiently spread between the layers and that the spacing between the layers is minimal. Thus, conventional clamps, such as C-clamps are utilized to hold the layers together as the adhesive cures or dries. Various sizes of the clamps may be used for various sizes of structures. For instance, for relatively large structures, C-frame tools may be used. The clamps, however, require that at least a portion of the structure is accessible from at least one side for the arms of the clamp to reach around. For complex structures and structures that are not easily accessible, it is difficult if not impossible to utilize a clamp. In addition, bulkheads, fittings and the like in the structure also interfere with the use of a clamp on the structure.

Many of the tasks detailed above could be avoided if a technique existed for clamping multiple layer structures together securely enough to prevent the layers from separating during an operation. In particular, a need exists for a clamping technique that securely holds the multiple layers of a structure together proximate the location where the operation is to take place. The needed technique should therefore provide a way to perform operations on a multiple layer structure that is more efficient, faster and less expensive than the conventional procedures utilized in performing such operations.

Conventional electromagnets have been considered to clamp multiple layer structures together, such as by positioning an electromagnet on one side of the structure and a piece of ferrous material on the other side. If any gap exists between a conventional electromagnet and the ferrous material, however, significant losses in the force between the electromagnet and the ferrous material result. Conventional electromagnets, therefore, do not create enough force to securely clamp multiple layers of a structure together because the force between a conventional electromagnet and the piece of ferrous material is subject to the inverse square law, i.e., the force is proportional to the inverse square of the distance between the electromagnet and the piece of ferrous material. For example, a conventional electromagnet, such as the EM-476 flat-faced electromagnet commercially available from Magnetool, Inc. of Troy, Mich., with dimensions of 4"×8"×2½" creates a force of 2000 lbs. on a piece of ferrous material when no gap exists between the electromagnet and the ferrous material. If a 1/16-inch gap of air or any non-ferrous material is introduced between the electromagnet and the ferrous material, the force between the electromagnet and the ferrous material drops to 95 lbs., which is not a sufficient amount of force to securely clamp a multiple layer structure together. Since the structures are often formed of a non-ferrous material, however, this marked decrease in the clamping force due to the gap created by the structure poses a significant limitation upon the use of electromagnets for clamping any type of structure, including multiple layer structures.

Therefore, to utilize an electromagnet for clamping a multiple layer structure, an electromagnet capable of creating a significant amount of force between the electromagnet and a piece of ferrous material, even when there is a gap between the electromagnet and ferrous material, is needed. In particular, the needed electromagnet must create a sufficient amount of force to securely clamp multiple layer structures such that an operation, such as drilling, may be performed on the structure.

BRIEF SUMMARY OF THE INVENTION

The electromagnetic clamp for a structure and associated clamping method of the present invention provide techniques for securely clamping a structure, such as a multiple layer structure. In addition, the clamp and method of the present invention provide techniques for clamping a structure, particularly proximate the location where an operation is to be performed, in such a way that an operation may be performed on the structure without the layers separating. The techniques provided by the present invention are effective and easy-to-use, which therefore reduces the cost and time involved in performing an operation on structures, as compared to conventional procedures.

The electromagnetic clamp of the present invention includes an electromagnet and a clamping piece, and the electromagnet includes a coil and a core that is located within a longitudinal aperture defined by the coil. The electromagnet may be energized by transmitting an electric current through the coil. The coil may be made of revolutions of wire, which may be copper wire, and/or may have a square-shaped cross-section. In addition, spacers may be located between the revolutions of wire to facilitate cooling the wire. Furthermore, the wire may define a hollow portion along a longitudinal axis of the wire, and fluid may flow through the hollow portion to facilitate cooling the wire.

The electromagnet and clamping piece are separated by a distance for receiving the structure therebetween. The electromagnet therefore attracts the clamping piece through the structure when the electromagnet is energized, such that the electromagnet and clamping piece exert compressive force on the structure. The force exerted on the structure, such as a multiple layer structure, holds the structure between the clamping piece and the electromagnet. For instance, the electromagnetic clamp may hold together a nonferrous structure that is at least 1/16 of an inch thick with sufficient force for an operation, such as drilling and/or fastener installation, to be performed on a multiple layer structure without the layers separating. In particular, the electromagnetic clamp may hold together a nonferrous structure that is at least 2/5 of an inch thick with at least 300 pounds of force.

In general, the smallest lateral dimension of the core of the electromagnet is chosen to maximize the flux density between the core and the clamping piece. As such, the smallest lateral dimension of the core of the electromagnet is typically greater than the distance between the clamping piece and the electromagnet. For instance, the smallest lateral dimension of the core may be at least three times the distance between the clamping piece and the electromagnet. The core and the clamping piece may be made of steel, but the core may be made of steel with a higher permeability than the steel of the clamping piece. The core also may be made of a steel having a higher saturation flux density than the steel of the clamping piece. The core also may define a longitudinal aperture, which may have a diameter that is less than ten percent of the area of the core. The longitudinal aperture may permit operations, such as drilling and/or fastener installation, to be performed on the structure through the electromagnet.

The electromagnetic clamp of the present invention also may include flux return sections that at least partially enclose the coil and/or the core of the electromagnet. At least one concentrator may also be located between the structure and the electromagnet and/or the clamping piece to concentrate the force exerted on the structure near the concentrator. The concentrator(s) may be made of ferrous material, and/or the concentrator(s) may be made of non-ferrous material and be less than 0.05 inches thick. In other embodiments, the concentrator(s) may be located proximate one end of said electromagnet and said clamping piece. In these embodiments, at least one secondary support located proximate the other end of said respective electromagnet and said clamping piece to create a moment opposite to the moment created by the initial concentrator.

The method for clamping a structure according to the present invention includes providing an electromagnet that includes a core having a lateral dimension and a coil about the core. In some embodiments of the electromagnet, the smallest lateral dimension of the core of the electromagnet may be three to five times greater than the thickness of the portion of the structure to be clamped. A clamping piece, as described above, is then positioned in operable contact with the structure. The electromagnet is also positioned in operable contact with the structure opposite the electromagnet, and such that an opening defined by the electromagnet coincides with a location at which an operation is to be performed on the structure. In positioning the electromagnet, the coil portion of the electromagnet may be positioned proximate the structure. In addition, the clamping piece and electromagnet are positioned on opposite sides of the structure such that the distance between the electromagnet and the clamping piece is less than the smallest lateral dimension of the core of the electromagnet. The electromagnet is then energized, such as by transmitting an electric current through the coil portion of the electromagnet, to securely hold the structure together between the clamping piece and the electromagnet. Energizing the electromagnet may, therefore, include exerting at least 300 pounds of force on the nonferrous structure, which is at least 1/16 of an inch thick.

If the electromagnet and/or the clamping piece include one or more concentrator portions, then the concentrator portion (s) may be positioned in operable contact with the structure. In addition, the electromagnet may be cooled by permitting a fluid to flow through the electromagnet at least while the electromagnet is energized.

The present invention also includes a method of fabricating an electromagnet, such as for use with an electromagnetic clamp for clamping a structure. A flux return backplate is fixed to the one end of a core and a cover plate is fixed to the other end of the core. A pressure plate may be positioned on the side of the cover plate opposite the flux return backplate to provide support for the cover plate as a plurality of layers of wire are wound about the core between the flux return backplate and the cover plate. Once the wire is wound about the core, the pressure plate may be removed. Prior to winding the layers of wire, a non-conductive material may be applied to the core and/or the flux return backplate. A flux return ring is fixed about the outer circumference of the cover to at least partially enclose the wire. The flux return ring may define a groove that may be aligned with the cover plate, such that an outer edge of the cover plate may be positioned within the groove to retain the cover plate on the core. Whether or not the flux return ring defines such a groove, fasteners may extend through the flux return backplate and the cover plate to retain the cover plate on the core after the wire is wound on the core. If a pressure plate is utilized, it may be removed anytime after fixing the flux return ring.

Thus, the electromagnetic clamp and method for clamping a structure of the present invention provide techniques for securely clamping structures, such as multiple layer structures, to prevent the layers of the structure from separating during an operation, while other aspects of the present invention provide a method for fabricating an electromagnet capable of creating the force necessary to securely clamp the structure. Due to the configuration of the core and coil of the electromagnet, it is capable of cooperating with a piece of ferrous material to create a significant amount of attractive force, even when there is a gap between the electromagnet and the ferrous material. In addition, the electromagnet securely clamps the structure proximate the location where the operation is to take place. The clamp and method of the present invention therefore provide a way to perform operations, such as drilling and fastener installation, on a structure, such as a multiple layer structure, that is more efficient, faster and less expensive than the conventional procedures utilized in performing such operations.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The electromagnetic clamp and method for clamping a structure of the present invention provide techniques for securely clamping structures, such as multiple layer structures, to prevent the layers of the structure from separating during an operation, while other aspects of the present invention provide a method for fabricating an electromagnet capable of creating the force necessary to securely clamp the structure. Due to the configuration of the core and coil of the electromagnet, it is capable of cooperating with a piece of ferrous material to create a significant amount of attractive force, even when there is a gap between the electromagnet and the ferrous material. In addition, the electromagnet securely clamps the structure proximate the location where the operation is to take place. The clamp and method of the present invention therefore provide a way to perform operations, such as drilling and fastener installation, on a structure, such as a multiple layer structure, that is more efficient, faster and less expensive than the conventional procedures utilized in performing such operations. In addition, the clamp and method of the present invention provides a technique for securely holding together multiple layer structures under a controlled pressure while adhesive between the layers cures or dries.

Figure 1:
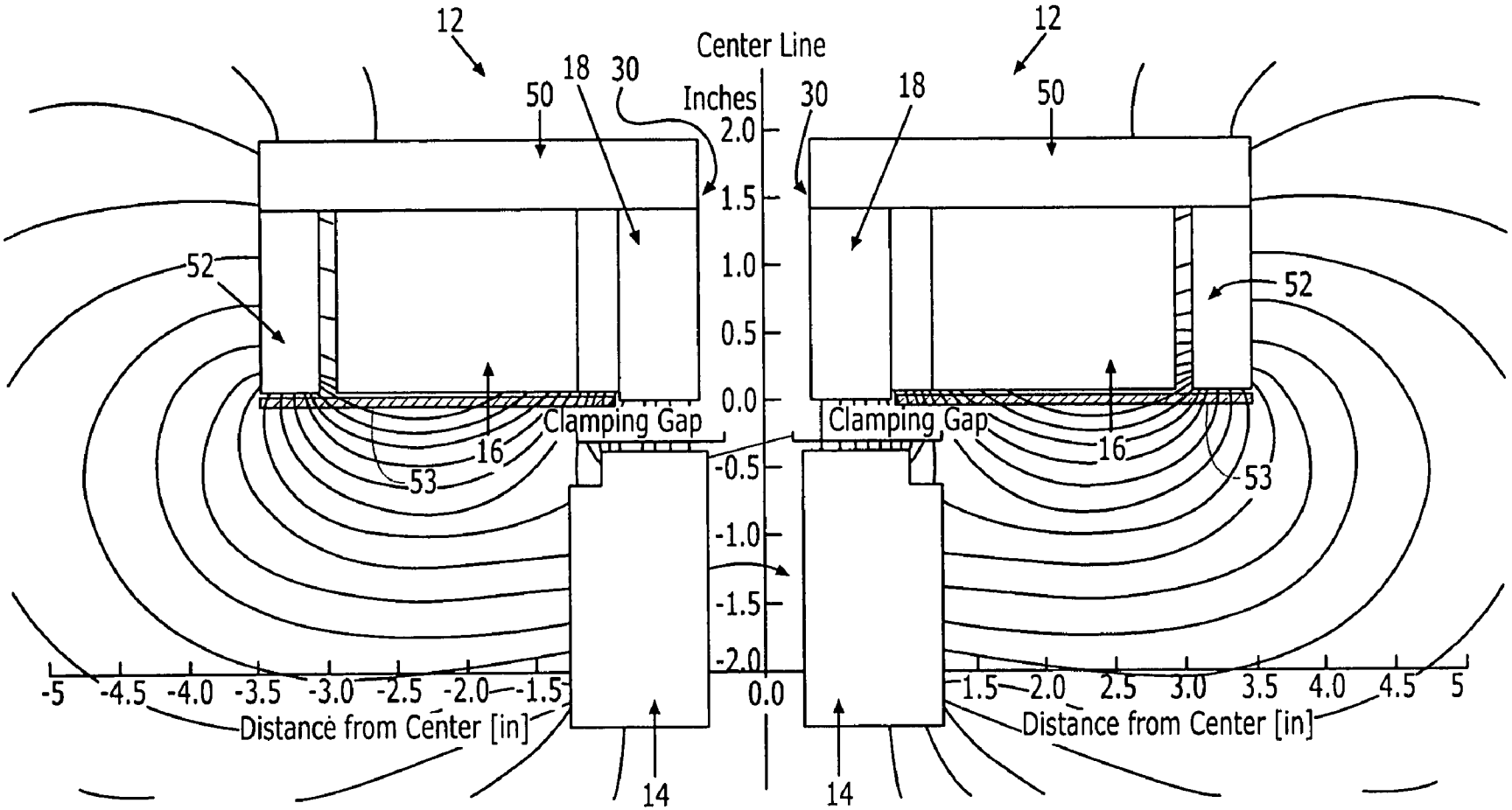
FIG. 1 illustrates a partial cross-sectional view of the electromagnetic clamp and the flux between the electromagnet and the clamping piece when a gap exists between the electromagnet and the clamping piece, according to one embodiment of the present invention.

FIG. 1 illustrates a partial cross-section of the electromagnetic clamp 10 of the present invention. The electromagnetic clamp 10 includes an electromagnet 12 and a clamping piece 14. The electromagnet 12 is configured such that large flux densities are created between the electromagnet 12 and the clamping piece 14, even when a gap, such as a gap of 0.25 to 0.75 inches, exists between the electromagnet 12 and the clamping piece 14. The gap may consist of air and/or any type of non-ferrous material between the electromagnet 12 and the clamping piece 14. For instance, in the examples described hereinbelow, the gap consists of multiple layers of non-ferrous material that will subsequently be fastened together. In other embodiments, however, the gap may consist of any other type of structure, such as a structure or a portion of a structure made from a solid piece of material, i.e, without layers. As such, when the structure is a multiple layer structure, the electromagnetic clamp 10 may be utilized to securely clamp the multiple layers of material while an operation is performed on the layers, such as drilling and/or fastener installation. The electromagnetic clamp 10, however, may be utilized in any other application in which a gap exists between the location of the electromagnet and the location of the clamping piece.

Figure 2:
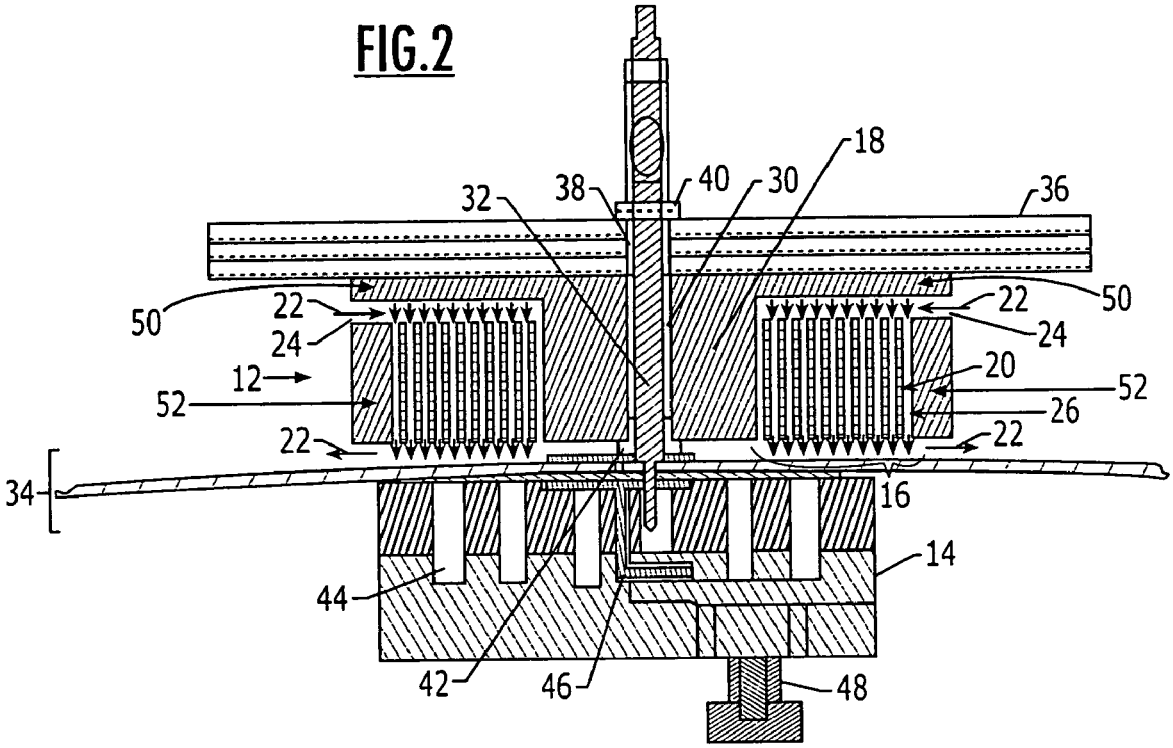
FIG. 2 illustrates a cross-sectional view of the electromagnetic clamp clamping a multiple layer structure between the electromagnet and the clamping piece, while a drilling operation is being performed on the multiple layer structure, according to one embodiment of the present invention.

The electromagnet 12 includes a coil 16 and a core 18. The coil 16 may be made of a plurality of revolutions of wire 20 wrapped about the core, as shown in FIG. 2. The wire may be made of any type of conductive material, such as copper. In addition, the cross-section of the wire 20 may be shaped as desired, such as a square cross-section wire, commercially available from MWS Wire Industries, for ease of winding and/or stacking of windings. In other embodiments, at least a portion of the wire 20 may have a circular, oval, or other cross-sectional shape. The wire 20 that is utilized in coil 16 may be a "magnet wire," as known to those skilled in the art, and may have a relatively thin insulation layer. Regardless of the type or cross-section of the wire, in some embodiments, 12-gauge to 16-gauge wire may be utilized for ease of winding.

To energize the electromagnet 12, an electric current may be transmitted through the coil 16. As such, the electromagnet 12 may be connected to a power source that supplies the electric current, such as an AC and/or DC current. When energized by the current, the electromagnet attracts any magnetic material, such as ferromagnetic material, as described in detail hereinbelow. For instance, in the embodiments of the electromagnet in which the coil is made of 12-gauge to 16-gauge wire, a 20 to 50 Ampere electric current may be transmitted through the coil 16 for the electromagnet to attract a magnetic material. If an AC current is used to energize the electromagnet, the electromagnet, except for the coil 16, is preferably made of a relatively high resistivity material, and may be laminated (constructed of thin layers) in order to reduce power loss and heating due to eddy currents in the material.

To create the amount of force necessary to clamp a multiple layer structure, i.e., several hundred pounds, a relatively large amount of electric current, such as more than 1000 amps/square inch of wire, may be transmitted through the coil 16 to energize the electromagnet 12. The electric current therefore increases the temperature of the wire 20, and the electromagnet 12 may require cooling, at least during times of electromagnet operation. In one embodiment, the cooling may occur by generating an air flow 22 around the wire 20 of the electromagnet 12. Thus, an air flow generator, such as a source of compressed air, may be in fluid communication with the electromagnet 12 in any manner known to those skilled in the art. FIG. 2 illustrates the air flow 22 entering the electromagnet 12 at one or more apertures 24, but the air flow 22 may begin at any other appropriate location. In addition, to facilitate cooling, spacers 26 may be placed between the revolutions of wire 20. The spacers 26 may be made of any type of material with a high melting temperature that is also, preferably, non-abrasive and non-conductive, such as Teflon™, commercially available from du Pont de Nemours and Company Corporation, fiberglass, or a weave material. As discussed above, the wire 20 may have a square-circumferential shape, or any other shape, that readily stacks within the spacers 26. Another manner in which the cooling may occur is by pumping fluid through a housing of the electromagnet 12 that encloses the wire 20 and/or around the wire 20. The pumping system may cool the fluid and, when the fluid flows through the electromagnet 12, it cools the electromagnet 12. To transport the fluid about the wire 20, one embodiment of the electromagnet 12 may define channels in the flux return section 50. The channels may be defined such that that the wire 20 cannot fall into the channels. Fluid may then enter the electromagnet 12, such as via a fluid compression fitting in the electromagnet, and flow through the channels. The fluid then may exit the electromagnet in any manner known to those skilled in the art, such as through openings in the cover plate 53 or by diverting the fluid through additional channels or spacers between the wire 20 and the cover plate 53. In further embodiments of the electromagnet 12, the wire 20 may be hollow, and a fluid may flow through the hollow portion of the wire to cool the wire. Regardless of the type of cooling, the fluid utilized to cool the wire 20 may be any type of cooling material, such as air, water, any other type of gas, or other liquid, such as Fluorinert™, commercially available from the Minnesota Mining and Manufacturing Company Corporation.

As shown in FIGS. 1 and 2, the coil 16 may be advantageously positioned near the gap between the electromagnet and the clamping piece, or near the surface of the structure to be clamped. Although the coil may be positioned in other portions of the electromagnet, by positioning the coil 16 near the surface to be clamped, the high current density in the coil 16 saturates the core 18, which creates increased flux density between the core 18 and the clamping piece 14. As such, the close proximity of the coil 16 to the gap and the clamping piece 14 allows a greater proportion of the generated flux to be intercepted by the clamping piece and to contribute to the clamping force. The flux density between the core 18 and the clamping piece 14 is illustrated in FIG. 1 as the lines 28 between the facing surfaces of the core 18 and the clamping piece 14. The amount of force between the core 18 and the clamping piece 14 is a strong function of the flux density between the core 18 and the clamping piece 14 and of the area over which the flux is near its maximum. As such, an increase in the flux density corresponds to an increase in the force. Specifically, the amount of force between the core 18 and the clamping piece 14 is approximately proportional to an integration of the square of the flux density in the region between the core and the clamping piece, which may be referred to as the Maxwell stress. The depth of the clamping piece 14, at least in the region of the clamping piece that is near the core 18, also may affect the amount of force between the core 18 and the clamping piece 14. Typically, the depth of the clamping piece 14, at least in the core 18 region, should be great enough to avoid flux saturation when the electromagnet 12 is fully energized, which for many steels generally occurs when the internal magnetic field of the electromagnet is approximately 2 Teslas. As shown in FIGS. 1 and 2, the clamping piece 14 may define at least one aperture 44 that extends at least partially through the clamping piece facing the structure 34 that may be shaped to receive a portion of the structure 34 and to be capable of sliding over any protrusions in the structure, as explained below. In embodiments of the clamping piece that include at least one aperture 44, the design of the clamping piece 14, particularly the depth of the clamping piece in the region of the core, may compensate for the aperture(s) to ensure avoidance of flux saturation of the clamping piece.

The coil 16 defines a longitudinal aperture extending at least partially through the coil. The core 18 of the electromagnet 12 is positioned at least partially within the aperture of the coil 16. The core 18 is typically made of a high-permeability material, where the relative permeability of the material is defined as a ratio of the strength of the magnetic field with the material to the strength of the magnetic field without the material. For example, the relative permeability of steel utilized in embodiments of the present invention is typically at least 100. For instance, the core 18 may be made of high-permeability ferrous material, such as 1010, 1018, 1020 low-carbon steel, or the like. In one embodiment, the core 18 may be made of steel with a higher permeability than the steel of the clamping piece 14. In further embodiments, the core 18 may be made of a steel with a higher saturation flux density than the steel of the clamping piece 14. For instance, in various embodiments of the electromagnet 12, the core 18 may be made of Hiperco™ 50, commercially available from Carpenter Technology Corporation, any other type of iron cobalt magnetic alloys, and/or carbon steel that has a relatively high saturation flux density and a relatively high permeability.

In some embodiments of the electromagnet 12, the core 18 may have a circular cross-section, but in other embodiments, the core may have other cross-sections, depending upon the application of the electromagnetic clamp. Furthermore, the coil 16 and the other portions of the electromagnetic clamp may have a circular cross-section or any other shaped cross-section, such as, but not limited to an oblong shaped cross-section. The shape, and in particular, the smallest lateral dimension of the core 18 is optimized to create the maximum amount of flux density, and therefore force, between the core 18 and the clamping piece 14. Embodiments of the electromagnet 12 therefore may include a core 18 having a smallest lateral dimension that is greater than the distance between the clamping piece and the electromagnet. In general, the size of the core 18 is optimized when an additional increase in the core size substantially reduces the flux density in the core. For instance, the smallest lateral dimension of the core 18 may advantageously be at least approximately three times greater than the distance between the clamping piece and the electromagnet in order to maximize the flux density.

In further embodiments of the electromagnet 12, the core 18 may define a longitudinal aperture 30, as shown in FIG. 2. To maintain a sufficient amount of flux density between the core 18 and the clamping piece 14, the area of the longitudinal aperture 30, as measured in a plane perpendicular to the longitudinal axis, is advantageously less than ten percent of the area of the core 18. In other embodiments, one or more longitudinal apertures may be defined by the coil 16 and/or any other part of the electromagnet. The longitudinal aperture 30 provides an opening through which operations may be performed on the structure. As illustrated in FIG. 2, a drill bit 32 of a drilling tool may extend through the electromagnet 12 to drill a hole in the multiple layer structure 34. As such, in certain embodiments, the electromagnet 12 may be attached to a platform 36 having an opening 38 that is aligned with the longitudinal aperture 30 of the electromagnet 12. The platform 36 not only protects the electromagnet, but also may provide a place to mount various tools, such as a drilling tool or the like, that may be used to perform operations on the structure. The platform 36 also may include an alignment piece 40, such as a bushing or the like, to align a tool with the opening 38 and therefore the longitudinal aperture 30. In other embodiments, a platform may not be attached to the electromagnet 12, but an alignment piece 40 may be positioned about the portion of the longitudinal aperture 30 opposite the structure 34. Regardless of whether the electromagnet 12 is attached to a platform, a second alignment piece 42 may be located about the portion of the longitudinal aperture 30 that faces the structure 34. Further details regarding the clamping of structures and operations that may be performed on the clamped structure are included in U.S. patent application Ser. No. 10/158,285, filed on May 30, 2002, and entitled "Apparatus and Method for Drilling Holes and Optionally Inserting Fasteners," which is incorporated herein by reference.

The clamping piece 14 may be made of a high-permeability ferrous material, such as 1010, 1018, 1020 low-carbon steel, or the like. Thus, the clamping piece 14 may be made of any type of material that the electromagnet 12 will attract when energized.

Prior to, while, or after positioning an longitudinal aperture 30 in the electromagnet in alignment with the location on the structure 34 to be drilled, the clamping piece 14 may be placed on the opposite side of the structure 34. The clamping piece 14 and electromagnet 12 are placed on opposite sides of the multiple layer structure 34, such that when the electromagnet 12 is energized and attracts the clamping piece 14, the layers are tightly clamped together.

The clamping piece 14 may define at least one aperture 44 that extends at least partially through the clamping piece. As such, the at least one aperture 44 faces the structure 34 and is aligned with the aperture 30 in the electromagnet 12. The embodiment of the electromagnetic clamp shown in FIG. 1 illustrates a clamping piece 14 having one aperture 44 that extends through the clamping piece and is aligned with the aperture 30 in the electromagnet 12. The embodiment shown in FIG. 2 illustrates that the clamping piece 14 may be shaped to attach to the structure 34. The clamping piece 14, for example, may be shaped to receive a portion of the structure 34 and to be capable of sliding over any protrusions in the structure. For example, in the aerospace industry, the clamping piece 14 may be shaped to receive a longeron 46 and to be capable of sliding along the longeron 46. In addition, the clamping piece 14 may have more than one aperture 44 in the form of grooves in the clamping piece, through which any existing fasteners in the structure may pass, thereby permitting the clamping piece 14 to freely slide. As such, the surface of the clamping piece 14 that contacts the structure 34 and longeron 46 may be coated with a layer of non-abrasive material, such as Teflon™, commercially available from du Pont de Nemours and Company Corporation, to avoid harming the structure 34 or longeron 46. Alternatively, multiple clamping pieces 14 may be placed along the portion of the structure 34 to be drilled, so that the clamping pieces 14 do not need to be slid as often, as far, or at all. In another embodiment, the clamp 14 may be shaped to cover the length of the area of the structure 34 to be drilled, such that the clamping piece 14 does not have to be slid. Furthermore, in certain embodiments of the electromagnet 12, the electromagnet may be shaped, such as but not limited to an oblong shape, to accommodate more than one longitudinal aperture 30, such that more than one operation may be performed through the longitudinal apertures 30 without having to move the electromagnet 12.

To perform an operation on the structure 34, the aperture 44 of the clamping piece 14 may be aligned with the aperture 30 of the electromagnet 12. To facilitate alignment of the clamping piece 14 and the electromagnet 12, either the clamping piece 14, the electromagnet 12, or both may have an alignment indicator. The alignment indicator presents some type of signal when the clamping piece 14 and the electromagnet 12 are properly placed on opposite sides of the work piece relative to each other. For example, a permanent magnet may be placed on the clamping piece 14 and/or the electromagnet 12, and the alignment indicator located on the other one of the electromagnet 12 and/or the clamping piece 14 with the alignment indicator being embodied by a magnetic sensor capable of providing a signal, such as a mechanical movement of a needle or the like, or the illumination of a light, upon detecting the presence of the magnet, such as via magnetoresistive sensors and/or Hall effect sensors that drive a comparator circuit to control the indicator light.

Once the clamping piece 14 of the embodiment of FIG. 2 is in place, it may be secured to the structure 34, such as the longeron 46, by any manner known to those skilled in the art. For instance, the clamping piece 14 may have two segments that cooperate to define a recess that is shaped to receive the portion of the structure upon which the clamping piece 14 rides. The clamping piece 14 may also include a threaded connector having a knob 48 that is accessible and may be rotated to move the two portions of the clamping piece 14 closer together and to secure the clamping piece 14 on the desired portion of the structure. In another example, the two segments of the clamping piece 14 may be hingedly connected, such that when the two segments are rotated into alignment with each other about the desired portion of the structure, the segments may be locked into place by any manner known to those skilled in the art, such as a spring lock, in order to be secured to the structure. In other embodiments of the electromagnetic clamp 10, the clamping piece 14 may not be secured to the structure prior to energizing the electromagnet 12. As such, the clamping piece and/or the electromagnet 12 may be manually and/or gravitationally held onto structure 34 once they are aligned. Furthermore, the clamping piece 14 or the electromagnet 12 may be positioned on a stable surface of some type, with the structure 34 positioned as desired on the clamping piece 14 or the electromagnet 12. The other of the clamping piece 14 or the electromagnet 12 may be positioned on the structure 34, and aligned as described above, if appropriate. Further details regarding the clamping piece of the present invention are included in U.S. patent application Ser. No. 10/158,285, filed on May 30, 2002, and entitled "Apparatus and Method for Drilling Holes and Optionally Inserting Fasteners," which is incorporated herein by reference in its entirety.

When both the electromagnet 12 and the clamping piece 14 are properly positioned, the electromagnet may be energized in order to apply a compressive force to the layers of the structure 34 between the electromagnet 12 and the clamping piece 14. The amount of force exerted upon the layers of the structure 34 should be sufficient to prevent the layers from moving apart during an operation, such as when a drilling tool 32 impinges each layer, and should be sufficient to ensure that the sealed layers are as close together as possible. For example, a force of at least 300 pounds may be exerted on a multiple layer structure that is ⅖ of an inch thick. In another example a force of at least 275 pounds may be exerted on a multiple layer structure that is ½ of an inch thick.

Thus, the electromagnet clamp 10 of the present invention allows operators to apply the sealant before drilling the hole in the structure and without having to wait for the sealant to dry because the energized electromagnet 12 and clamping piece 14 hold the layers together tightly enough to squeeze out extra sealant prior to drilling, prevent exit burrs from forming in the drilled hole, and prevent debris from accumulating between the layers during drilling. Therefore, the electromagnetic clamp 10 reduces the time and expense involved in drilling holes in multiple layer structures, in which the layers otherwise would have to be disassembled and cleaned after drilling, then reassembled with a fast-drying sealant, the excess of which must be squeezed out and the remaining sealant dried prior to fastening the layers. Further details regarding the clamping of multiple layer structures are included in U.S. patent application Ser. No. 10/158,285, filed on May 30, 2002, and entitled "Apparatus and Method for Drilling Holes and Optionally Inserting Fasteners," which is incorporated herein by reference.

The core 18 and/or the coil 16 may be at least partially enclosed by at least one flux return section 50, 52 as shown in FIG. 1, which minimize reluctance of the flux density path. The core 18 and/or the coil 16 may also be at least partially enclosed by a cover plate 53, as shown in the embodiment of FIG. 1. In one embodiment, the cover plate 53 may be made of a non-magnetic material and have a thickness of 0.03-0.06 inches. In addition, in an embodiment of the electromagnet clamp that provides approximately 300 pounds of force on the structure when the structure is formed of a nonferrous material and is greater than 1/16 of an inch thick, the cover plate 53 may be made of carbon fiber and have a thickness of approximately 0.04 inches. The flux return section(s) 50, 52 collect stray flux from the electromagnet 12, and from between the electromagnet 12 and the clamping piece 14. The flux return section(s) 50, 52 allow the electromagnet clamp 10 to be more efficient by channeling the flux density, and therefore the force, between the core 18 and the clamping piece 14 instead of around the electromagnet. In addition, to create an asymmetric electromagnet, a portion of the flux return section(s) 50, 52 may be removed. An asymmetric electromagnet may be advantageous in applications in which there is an obstruction near the area of the structure where the electromagnet 12 should be placed. Other types of asymmetric electromagnets may be made by forming the core 18 and/or the coil 16 in any desired shape, as described above, or by changing the location of the longitudinal aperture 30 in the electromagnet. The flux return section(s) 50, 52 may be made of any type of relatively high-permeability material, such as 1018 steel. In the embodiment of FIG. 1, flux return section 50 may be referred to as flux return backplate 50, and flux return section 52 may be referred to as flux return ring 52.

In other embodiments of the electromagnetic clamp 10 of the present invention, at least one concentrator may be positioned on the portion of the electromagnet 12 that faces the structure 34. In addition to, or instead of, the concentrator being positioned on the electromagnet 12, at least one concentrator may be positioned on the portion of the clamping piece 14 that faces the structure 34. When concentrator(s) are present on the electromagnet 12 and/or the clamping piece 14, the force exerted on the structure by the electromagnet 12 and the clamping piece 14 is concentrated on the structure at the point(s) of contact with the concentrator(s). As such, the amount of force exerted by the electromagnet 12 and the clamping piece 14 is the same whether or not concentrator(s) are utilized. Because the force is exerted over a smaller area when concentrator(s) are utilized, however, the pressure at the points of contact between the concentrator(s) and the structure is increased.

Figure 3:
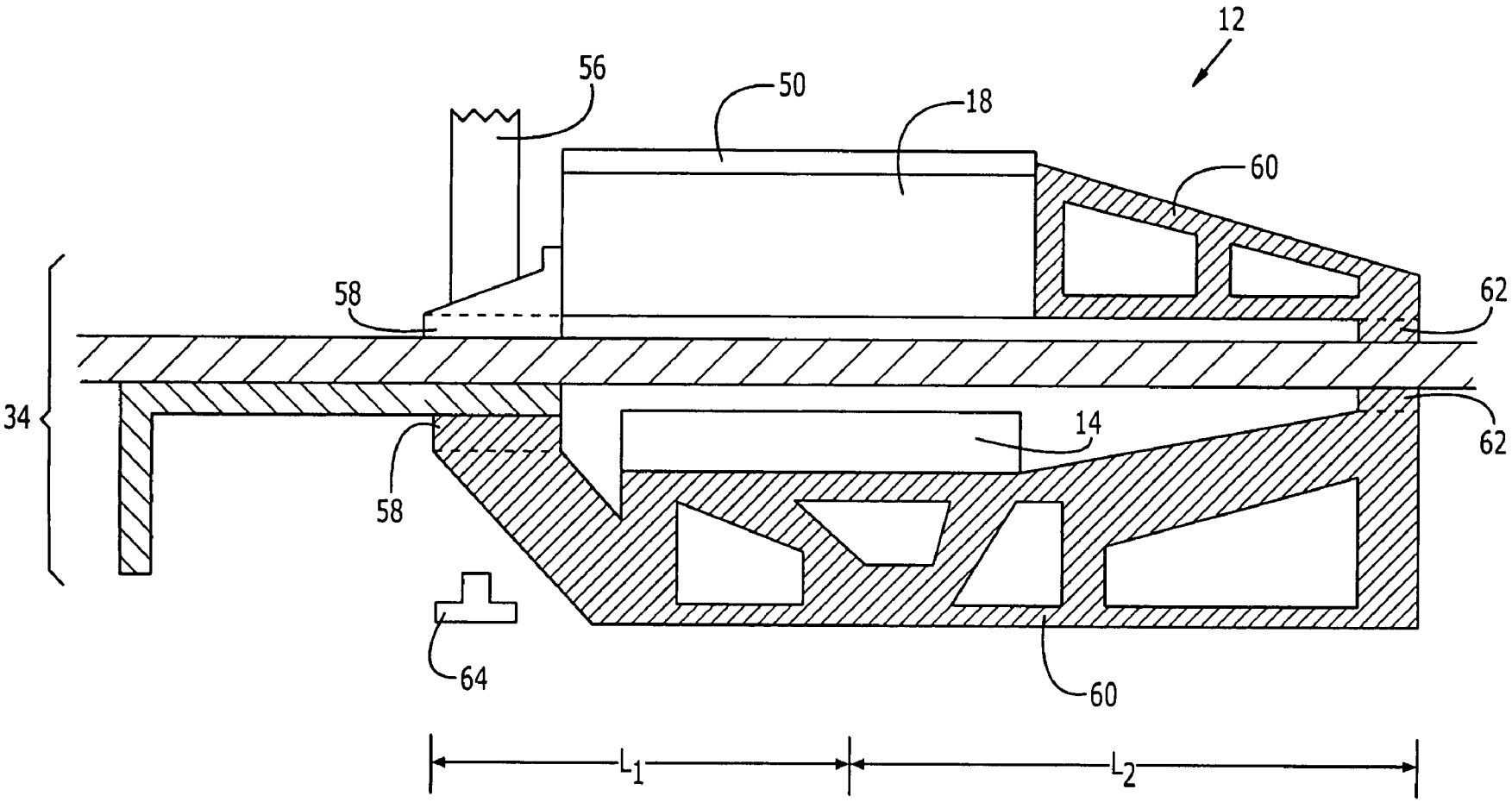
FIG. 3 illustrates a side elevation view of the electromagnetic clamp clamping a multiple layer structure between pressure concentrators offset from the core of the electromagnet and secondary supports, according to one embodiment of the present invention.

For example, in the embodiment of the electromagnetic clamp 10 shown in FIG. 2, the alignment piece 42 may serve as a concentrator. This concentrator is located about the area of the structure where an operation will subsequently be performed on the structure in order to ensure that the force between the electromagnet and the clamping piece is concentrated near that area, such that the structure is securely held together where the operation is to be performed. In other embodiments, the concentrator(s) may be located anywhere on the electromagnet 12 and/or clamping piece 14 where it is desired to concentrate the force between the electromagnet and the clamping piece. For instance, in an embodiment of the electromagnetic clamp that is advantageously utilized in conjunction with electromagnetic riveting operations, as shown in FIG. 3, the initial concentrators 58 may be located near an outside edge of the electromagnet 12 and/or the clamping piece 14, with secondary supports 62 located on the opposite edge of the electromagnet and/or clamping piece. The secondary supports 62 and/or the initial concentrators 58 may be attached to the electromagnet 12 and/or the clamping piece 14 via support arms 60. The support arms 60 may be made of any type of material having sufficient strength, such as aluminum. Positioning the secondary support 62 a distance from the core 18 that is equal to the distance of the initial concentrator from the core, i.e., $L_1=L_2$, creates an equal, but opposite, moment to the moment created by the initial concentrator. This embodiment permits the riveting operations, shown in FIG. 3 as the rivet gun 56 and fastener 64, to be performed with little interference from the electromagnet. In other embodiments, the secondary support 62 may be positioned a distance from the core that is larger than the distance of the initial concentrator from the core, i.e., $L_2>L_1$, in order to concentrate more of the electromagnet force at the initial concentrator 58.

The concentrator(s) may be made of ferrous material, such as a high-permeability steel, or non-ferrous material. For example, a non-ferrous material, such as Teflon™, commercially available from du Pont de Nemours and Company Corporation, rubber, and/or fiberglass material, may be utilized to make the concentrator(s) to prevent the concentrator (s) from scratching the structure. If a concentrator is made of non-ferrous material, however, the concentrator is advantageously less than 0.05 of an inch thick, such that the concentrator does not significantly add to the distance between the electromagnet 12 and the clamping piece 14.

As described with reference to the embodiments hereinabove, the electromagnet 12 is designed such that a maximum amount of force is created between the electromagnet 12 and the clamping piece 14. In some embodiments, the maximum amount of force is desired between the core 18 and the clamping piece, while in other embodiments, the force between the electromagnet 12 and the clamping piece 14 may be concentrated at other locations along the electromagnet 12 and/or the clamping piece 14, such as by the use of concentrators. A multiple layer structure 34 may therefore be securely clamped between the electromagnet and the clamping piece, with the force exerted on the structure near any desired location, such as near a location where an operation is to be performed on the structure.

The electromagnet 12 may be made in any manner known to those skilled in the art. One embodiment for making the electromagnet 12 includes wrapping the wire 20 about the core 18 one layer at a time to create multiple layers of wound wire, such as by utilizing a lathe to rotate and facilitate winding of the wire and optional spacers. In embodiments of the electromagnet 12 that include a flux return section about the side of the electromagnet opposite the structure, i.e., a flux return backplate 50, the flux return section prevents the wire from moving off of the core in one direction. In some embodiments of the electromagnet 12, a non-conducting material, such as Kapton™ tape commercially available from E.I. Du Pont De Nemours and Company Corporation, may be applied to the core 18 and/or the flux return backplate 50 prior to winding the wire on the core. Such non-conducting material reduces the possibility that abrasion between the wire and the core and/or the flux return backplate will cause the insulation on the wire to wear off of the wire, which could cause a short in the coil 16. The non-conducting material also prevents a high-voltage breakdown across the wire insulation, which may occur if the wire insulation is relatively thin, such as insulating varnish that is sometimes applied to wire utilized in electromagnets for insulation.

Figure 4:
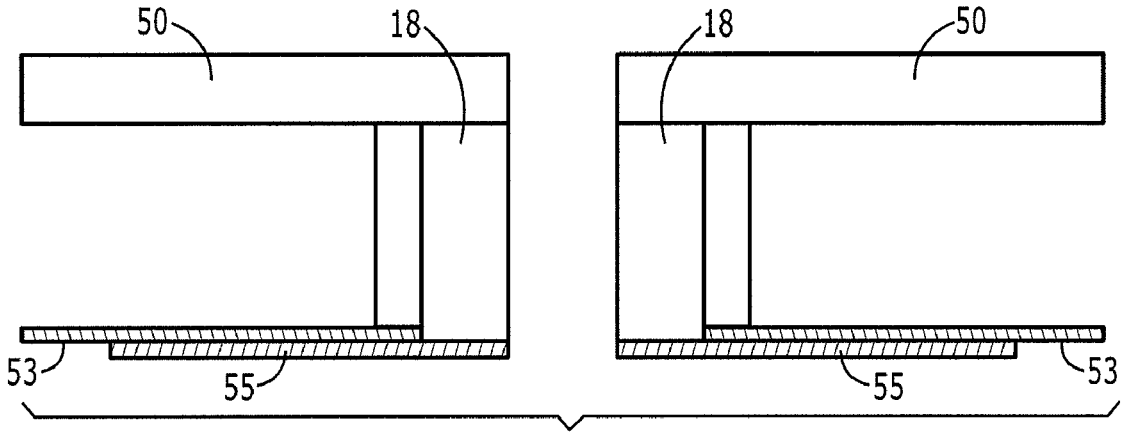
FIG. 4 is a schematic representation of a portion of an electromagnet including a pressure plate according to one embodiment of the present invention.
Figure 5:
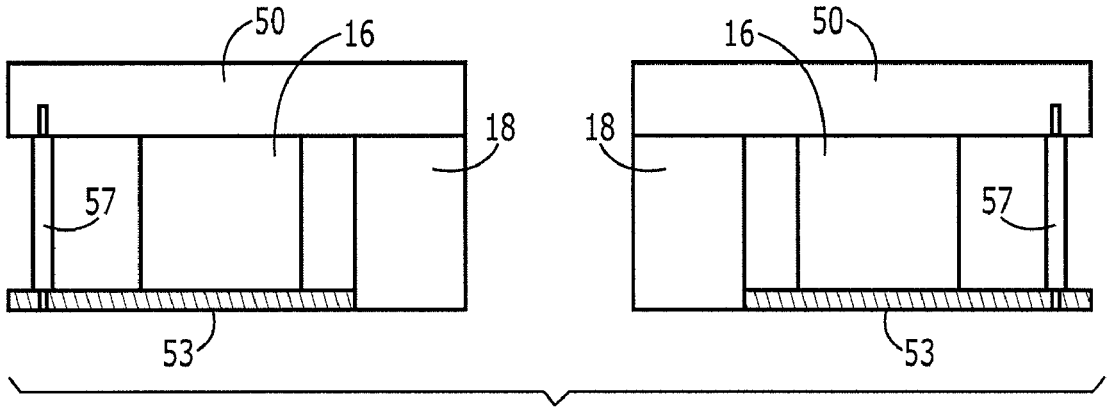
FIG. 5 is a schematic representation of a portion of an electromagnet including a fastener extending through a flux return backplate and a cover plate according to one embodiment of the present invention.

To prevent the wire from moving off of the core 18 opposite the flux return backplate 50, a cover plate 53 may be attached to core 18 to define a side of the electromagnet that faces the structure. The cover plate 53 is advantageously made of a low-permeability material, such as a carbon composite or stainless steel material, although it may be made of other materials, if desired. The cover plate 53, therefore, may remain as part of the electromagnet 12 after the wire 20 is wound on the core 18. The cover plate 53 may be relatively thin to maximize the flux density extending beyond the structure 34 to the clamping piece 14. For instance, in some embodiments, the depth of the cover plate 53 may be 0.03 to 0.06 inches, as described above. To keep the cover plate from deflecting as the wire 20 is wound on the core 18, a pressure plate 55, as shown in FIG. 4, may be applied on the side of the cover plate opposite the wire 20 while the wire is being wound on the core. The diameter of the pressure plate is smaller than the diameter of the cover plate, such that once the wire 20 is wound on the core 18, a flux return ring 52 may be applied about the outer circumference of the wire 20. The flux return ring 52 may define a groove aligned with the position of the cover plate, and therefore captures at least a portion of the outer circumference of the cover plate in the groove without also capturing the pressure plate. The pressure plate then may be removed, and the cover plate is secured in place by the grooved flux return ring. Alternatively, as shown in FIG. 5, fasteners 57 may extend from the flux return backplate 50 opposite the structure to the cover plate to secure the cover plate 53 to the electromagnet 12, which prevents the wire 20 from moving off of the core 18. For example, this embodiment could be utilized when there is no flux return ring about the outer circumference of the wire 20, or if the flux return ring does not define a groove for receiving the cover plate.

Once the electromagnet 12 and the clamping piece 12, as described in detail hereinabove, have been formed to maximize the flux density between the electromagnet and the clamping piece, a structure may be securely clamped between the electromagnet 12 and the clamping piece 14. To maximize the flux density, the diameter of the core 18 of the electromagnet may be optimized as compared to the thickness of the structure 34. For instance, the diameter of the core 18 may be larger than the thickness of the structure 34. The electromagnet 12 is positioned in operable contact with the structure, such that an opening defined by the electromagnet defines a location of an operation to be performed on the structure. In addition, the coil 16 of the electromagnet may be positioned such that it is proximate the structure. The clamping piece 14 also may be positioned in operable contact with the structure opposite the electromagnet 12, as shown in FIG. 2. If the electromagnet 12 and/or the clamping piece 14 include concentrator(s), then the concentrator(s) are positioned in operable contact with the structure 34.

The electromagnet 12 then may be energized as described above, which causes the electromagnet and the clamping piece to be attracted toward one another, and the structure 34 is therefore securely held between the electromagnet 12 and the clamping piece 14. Thus, when the electromagnet 12 is energized, it may exert over 300 pounds of force on the structure when the structure is formed of a nonferrous material and is greater than 1/16 of an inch thick. Because of the significant amount of electric current that flows through the coil 16 of the electromagnet to create the amount of force necessary to securely clamp the structure between the electromagnet and the clamping piece, the electromagnet may generate heat while it is energized. Thus, the electromagnet may be cooled with fluid flowing through at least a portion of the electromagnet during at least a portion of the time that the electromagnet is energized.

Thus, the electromagnetic clamp and method for clamping a structure of the present invention provide techniques for securely clamping structures, such as multiple layer structures, such that the layers cannot separate from one another during an operation. Due to the configuration of the core and coil of the electromagnet, it is capable of creating a significant amount of force between the electromagnet and a ferrous clamping piece, even when there is a gap between the electromagnet and the clamping piece. In addition, the electromagnet securely clamps a structure proximate the location where the operation is to take place. The clamp and method of the present invention therefore provide a way to perform operations, such as drilling and fastener installation, on a structure that is more efficient, faster and less expensive than the conventional procedures utilized in performing such operations.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of fabricating an electromagnet, comprising:

fixing a flux return backplate to one end of a core;

fixing a cover plate to the other end of the core;

winding a plurality of layers of wire about the core between the flux return backplate and the cover plate after the flux return backplate and the cover plate have been fixed to opposite ends of the core; and fixing a flux return ring about an outer circumference of the cover plate to at least partially enclose the wire after winding the wire about the core.

2. The method of fabricating an electromagnet according to claim 1, wherein the flux return ring defines a groove, and wherein fixing the flux return ring comprises aligning the groove with the cover plate and positioning an outer edge of the cover plate within the groove.

3. The method of fabricating an electromagnet according to claim 1, further comprising positioning a pressure plate on the side of cover plate opposite the flux return backplate prior to winding the plurality of layers of wire.

4. The method of fabricating an electromagnet according to claim 3, further comprising removing the pressure plate after fixing the flux return ring.

5. The method of fabricating an electromagnet according to claim 1, further comprising installing at least one fastener extending through the flux return backplate and the cover plate after winding the plurality of layers of wire.

6. The method of fabricating an electromagnet according to claim 1, further comprising applying a non-conductive material to the core prior to winding the plurality of layers of wire.

7. The method of fabricating an electromagnet according to claim 1, further comprising positioning a plurality of spacers between adjacent portions of the wire while winding the wire.

8. A method of fabricating an electromagnet, comprising:

providing a core having a flux return backplate on one end and a cover plate on the other end of the core;

winding a plurality of layers of wire about the core between the flux return backplate and the cover plate while the flux return backplate and the cover plate are affixed thereto; and fixing a flux return ring to the cover plate to at least partially enclose the wire after winding the wire about the core.

9. The method of fabricating an electromagnet according to claim 8, wherein the flux return ring defines a groove, and wherein fixing the flux return ring comprises aligning the groove with the cover plate and positioning an outer edge of the cover plate within the groove.

10. The method of fabricating an electromagnet according to claim 8, further comprising positioning a pressure plate on the side of cover plate opposite the flux return backplate prior to winding the plurality of layers of wire.

11. The method of fabricating an electromagnet according to claim 10, further comprising removing the pressure plate after fixing the flux return ring.

12. The method of fabricating an electromagnet according to claim 8, further comprising installing at least one fastener extending through the flux return backplate and the cover plate after winding the plurality of layers of wire.

13. The method of fabricating an electromagnet according to claim 8, further comprising applying a non-conductive material to the core prior to winding the plurality of layers of wire.

14. The method of fabricating an electromagnet according to claim 8, further comprising positioning a plurality of spacers between adjacent portions of the wire while winding the wire.

* * * * *